US009352208B2

(12) United States Patent
Davis et al.

(10) Patent No.: US 9,352,208 B2
(45) Date of Patent: May 31, 2016

(54) ELECTRONIC HOME PLATE FOR BASEBALL AND SOFTBALL GAMES AND METHOD FOR AUTOMATIC DETERMINATION OF PRESENCE, POSITION AND SPEED OF A BALL RELATIVE TO THE STRIKE ZONE

(71) Applicants: UNIVERSITY OF MARYLAND, COLLEGE PARK, College Park, MD (US); SPESSARD MANUFACTURING, LLC, Mercersburg, PA (US)

(72) Inventors: Christopher C. Davis, Bowie, MD (US); John Rzasa, College Park, MD (US); Gerald W. Spessard, Mercersburg, PA (US); Leroy B. Chamberlain, Jr., Berkeley Springs, WV (US); Jakob R. Scharmer, Hagerstown, MD (US)

(73) Assignees: University of Maryland, College Park, College Park, MD (US); Spessard Manufacturing, LLC, Mercersburg, PA (US)

( * ) Notice: Subject to any disclaimer, the term of this patent is extended or adjusted under 35 U.S.C. 154(b) by 147 days.

(21) Appl. No.: 13/833,366

(22) Filed: Mar. 15, 2013

(65) Prior Publication Data

US 2014/0206480 A1 Jul. 24, 2014

Related U.S. Application Data

(60) Provisional application No. 61/755,214, filed on Jan. 22, 2013.

(51) Int. Cl.
*A63B 69/00* (2006.01)
*A63B 71/00* (2006.01)

(Continued)

(52) U.S. Cl.
CPC ..... *A63B 71/0605* (2013.01); *A63B 69/0013* (2013.01); *A63B 24/0021* (2013.01); *A63B 63/00* (2013.01); *A63B 69/0002* (2013.01); *A63B 71/06* (2013.01); *A63B 2069/0006* (2013.01);

(Continued)

(58) Field of Classification Search
CPC ..... A63B 69/0002; A63B 69/0013; A63B 71/0605; A63B 71/06; A63B 63/00; A63B 24/0021; A63B 2069/0006; A63B 2071/0627
USPC ..... 473/422, 453–455, 490, 500
See application file for complete search history.

(56) References Cited

U.S. PATENT DOCUMENTS 727,633 A * 5/1903 Humphreys ..... 473/500
1,868,088 A * 7/1932 Blair ..... A63B 71/0605 473/499

(Continued)

*Primary Examiner* — Mitra Aryanpour
(74) *Attorney, Agent, or Firm* — Rosenberg, Klein & Lee

(57) ABSTRACT

An electronic home plate providing assistance to an umpire in determination whether a pitch results in a "strike" or a "ball". The electronic home plate is implemented with eye-safe LEDs producing light beams extending vertically. If a ball intersects the light beams, the light reflected from the ball is scattered and incident on photodetectors embedded in the home plate. A microcomputer embedded in the electronic home plate calculates the height of the ball crossing the light beams, and if the height falls between the top and bottom boundaries of a strike zone adjusted to the height of the batter, an indication system is activated to produce a "strike" signal. The microcomputer in the electronic home plate is further configured to calculate speed of the ball passing over the home plate, and the lateral position of the ball.

26 Claims, 10 Drawing Sheets

(51) Int. Cl.
*A63B 71/06* (2006.01)
*A63B 63/00* (2006.01)
*A63B 24/00* (2006.01)

(52) U.S. Cl.
CPC ..... *A63B2071/0627* (2013.01); *A63B 2207/02* (2013.01); *A63B 2220/13* (2013.01); *A63B 2220/30* (2013.01); *A63B 2220/805* (2013.01)

(56) References Cited

U.S. PATENT DOCUMENTS 2,113,899 A * 4/1938 Oram ..... 473/455
2,121,742 A * 6/1938 McLaughlin ..... 473/499
4,563,005 A * 1/1986 Hand et al. ..... 473/455
4,577,863 A * 3/1986 Ito ..... A63B 69/0002 473/453
4,583,733 A * 4/1986 Ito ..... A63B 69/0002 473/453
4,972,171 A * 11/1990 Johnson et al. ..... 473/455
5,401,016 A * 3/1995 Heglund et al. ..... 473/455
5,553,846 A * 9/1996 Frye ..... A63B 24/0021 473/458
5,553,860 A * 9/1996 Zelikovich ..... 473/455
5,676,607 A * 10/1997 Stumpf ..... 473/455
5,833,549 A * 11/1998 Zur ..... A63B 69/0002 473/453
5,984,810 A * 11/1999 Frye et al. ..... 473/455
6,042,492 A * 3/2000 Baum ..... 473/453
6,159,113 A * 12/2000 Barber ..... 473/454
6,350,211 B1 * 2/2002 Kolmar ..... 473/454
6,358,164 B1 * 3/2002 Bracewell et al. ..... 473/454
6,688,996 B1 * 2/2004 Mitani ..... 473/500
6,695,725 B1 * 2/2004 Burns, Jr. ..... 473/454
6,709,351 B2 * 3/2004 Hori ..... 473/455
7,150,688 B1 * 12/2006 Coulbourn ..... A63B 69/0002 473/415
7,270,616 B1 * 9/2007 Snyder ..... 473/453
7,335,116 B2 * 2/2008 Petrov ..... F41H 5/007 473/407
8,591,356 B2 * 11/2013 Walker ..... 473/456
2003/0171169 A1 * 9/2003 Cavallaro ..... A63F 13/10 473/455
2006/0183546 A1 * 8/2006 Addington ..... A63F 13/06 463/37
2014/0206480 A1 * 7/2014 Davis et al. ..... 473/455

* cited by examiner

ELECTRONIC HOME PLATE FOR BASEBALL AND SOFTBALL GAMES AND METHOD FOR AUTOMATIC DETERMINATION OF PRESENCE, POSITION AND SPEED OF A BALL RELATIVE TO THE STRIKE ZONE

REFERENCE TO RELATED APPLICATIONS

This utility patent application is based on the Provisional Patent Application No. 61/755,214 filed on 22 Jan. 2013.

FIELD OF THE INVENTION

The present invention relates to the games of baseball and softball; and more in particular, to a home plate system which is designed to assist umpires (or other officials) in qualifying a pitch as a "ball" or a "strike" by automatically determining the presence, position and speed of a baseball (or softball) passing over home plate.

The present invention also is directed to an electronic home plate (EHP) which is designed for baseball (and/or softball) games at both professional and non-professional levels, and is particularly targeted for a little league and scholastic league markets where the umpires are typically non-professional or volunteers.

In overall concept, the present invention relates to a home plate device equipped with an electronic sub-system embedded in the home plate and configured to detect the presence of a ball passing over the home plate and indicate if the ball passes within the boundaries of the strike zone pre-calculated for a particular batter of interest.

In addition, the present invention is directed to an electronic home plate equipped with infrared light emitting diodes generating invisible eye-safe light beams extending vertically above the home plate, and photodetectors embedded in the home plate to detect light reflected from the point where the light beam intersects the baseball (or softball) in order to activate ball/strike indicators to alert an umpire (or other official).

Moreover, the present invention is directed to an electronic home plate system which communicates wirelessly with an official's (umpire, scorekeeper, etc.) remote controller device to exchange signals therebetween, including wireless transmission of the strike indication signal from the EHP to the remote controller device.

Additionally, the present invention is directed to an electronic home plate (EHP) system, where an umpire (or another official of the game) is provided with a remote controller sub-system to wirelessly activate/deactivate the home plate device, as well as to wirelessly transmit the boundaries of the strike zone of each particular batter to the EHP.

BACKGROUND OF THE INVENTION

In baseball and softball, the strike zone is a conceptual right pentagonal prism over the home plate which defines the boundaries through which a pitch must pass in order to be counted as a "strike" when a batter does not swing the bat.

As shown in FIG. 1, the top 10 of the strike zone 12 is defined in the official rules of baseball as a horizontal line at the midpoint between the top of the batter's shoulders and the top of the uniform pants. The bottom 14 of the strike zone 12 is a line at the hollow beneath the kneecap of the batter. The right and left boundaries 16, 18 of the strike zone 12 correspond to the edges 20, 22, of the home plate 24. A pitch that touches the outer boundary of the strike zone is as much a strike as a pitch that is thrown right down the center of the strike zone. A pitch at which the batter does not swing and which does not pass through the strike zone is called a ball.

The home plate, formally designated home base in the rules, is a final base that the player must touch to score. The home plate is a five-sided slab of whitened rubber that is set at ground level. The batter stands in the batter's box when ready to receive a pitch from a pitcher.

In baseball, an umpire is a person charged with officiating the game, including beginning and ending the game, enforcing the rules of the game and the grounds, making judgment calls on plays, and handling disciplinary actions. In a game officiated by two or more umpires, the umpiring chief (home-plate umpire) is the umpire who is in charge of the entire game. This umpire calls balls and strikes, calls fair balls and foul balls, short of first/third base, and makes most calls concerning the batter or concerning base runner near home plate. The umpire 26 usually positioned behind the catcher's box and declares whether the pitch is a strike or a ball.

It is clear that human error may be present in judging whether a pitch passes through the strike zone or outside the boundaries. This is especially true in the case of little league and scholastic league baseball games where the umpires are typically non-professional and/or volunteers. The probability of human errors in these situations is increased.

It is therefore desirable to provide means to reduce human error in categorizing the pitch as a "ball" or a "strike" especially for use in baseball and/or softball leagues where the umpires are typically non-professional or volunteers.

SUMMARY OF THE INVENTION

It is therefore an object of the present invention to provide a technique free of human error automatic which quantitively determines the passage of a ball through the strike zone.

It is a further object of the present invention to provide an electronic home plate for use in baseball and/or softball leagues which would electronically detect a ball passing between the boundaries of the strike zone in order to determine whether the pitch is a "ball" or a "strike" free of human error.

It is another object of the present invention to provide an electronic home plate containing electronic and opto-electronic components to detect the presence and the height of the ball passing over the home plate and indicate whether the ball passes through the strike zone between its boundaries.

It is an additional object of the present invention to provide an electronic home plate system which is programmed to calculate the "strike" or "ball" based on the strike zone boundaries which are automatically adjusted for a batter of interest.

It is also an object of the present invention to provide the electronic home plate having electronic components embedded into the home plate housing to detect and indicate presence, position, and speed of the baseball passing over the home plate.

In one aspect, the present invention is an electronic home plate, (EHP) which comprises:

an EHP housing including an upper member and a bottom module defining a space therebetween, and, an array of first light emitting units embedded in the EHP housing at predetermined positions in proximity to the upper member. Each first light emitting unit generates a light beam extending vertically above the upper member of the EHP housing. A cross-section of the light beam varies therealong in a predetermined fashion. Particularly, the light beam diverges in the direction from the upper member of the EHP housing.

The first light emitting units (LEDs) generate light in an invisible infrared spectrum range. One or three photodetector unit(s) is (are) embedded in the EHP housing in proximity to the upper member.

A microcomputer unit preferably, in the form of a FPGA (Field-Programmable Gate Array) is embedded in the EHP housing in operative connection to the photodetector units. The microcomputer unit is configured to determine the passage of a baseball within the boundaries of the strike zone adjusted for the batter's height (and/or other vital statistics) based on the photodetectors' output readings.

The EHP further comprises an indicator unit embedded in the EHP housing and operatively coupled to the microcomputer unit. The microcomputer activates the indicator unit to produce a "strike" signal when the baseball passes within the strike zone boundaries.

The indicator unit may include a plurality of second light emitting units embedded in the EHP housing and emitting visible light. Alternatively, the indicator unit generates an audible signal.

The indicator unit also may transmit the "strike" signal wirelessly to a destination transceiver, such as, for example, cell phones of viewers, or to a remote controller (computer) of the game officials.

In the EHP system, the photodetector detects light reflected from a ball crossing light beam(s) at a particular crossing height. The microcomputer calculates the crossing height in accordance with the ratio of the pulse width to the gap in between the two pulses (corresponding to crossing of two light beams, respectively), and determines whether the crossing height falls within the top and bottom boundaries of the strike zone. The lateral position is calculated by the ratio of the peak power detected at the three photodiodes.

The first LEDs may be disposed along a line at the front of the EHP housing. The second row of LEDs is positioned where the plate begins to taper towards a point.

The microcomputer unit is further configured to determine time spacing between detection events corresponding to two light beams crossed by the baseball, and calculate a speed of the baseball passing over the EHP by dividing the distance between the two light beams by the time spacing between two light beam crossing events.

The EHP system further comprises a remote controller sub-system, which is connected to the EHP via a wireless communication channel. The remote controller is operated by an umpire (or other game official). The remote controller has a switch controlled by the user to switch the EHP between the "ON" and "OFF" modes of operation. The remote controller further has a "CLEAR" switch actuated by the user to produce a "CLEAR" signal transmitted to the microcomputer in the EHP to deactivate the first LEDs prior to delivery of a pitch.

A battery (or wired power) is provided in the EHP to energize sub-systems of the EHP when "armed" by the umpire through the wireless transmission of an "arm" signal from the remote controller.

The remote controller has a database of strike zone parameters corresponding to vital statistics of eligible batters. By "clicking" on a jersey number of a batter of interest (as provided by the remote controller), the user may wirelessly transmit the strike zone parameters to the EHP prior to the pitch delivery.

An optical signal amplification and conditioning unit is coupled to an output of each photodetector. In addition, an ambient light rejection unit is coupled to the output of the amplification and conditioning circuitry to eliminate unwanted effects of direct sunlight or stadium lighting exposure.

In order to withstand mechanical stress during the game, the EHP housing is provided with shock absorbing mechanism which is implemented with a removable electronics module of the EHP housing. The electronics is positioned in the removable electronics module which is plugged into a vault mounted into the ground. The upper member of the EHP is made of a rubber and is attached removably to the electronics module. A mechanical shock applied to the rubber top member is then directed into the ground around the electronics module.

In another aspect, the present invention is a method for automatically determining a "strike", as well as position and speed of the ball, in baseball games. The subject method comprises the steps of:

(a) installing an Electronic Home Plate (EHP) at a predetermined position on a baseball field, where the EHP includes:

an EHP housing formed of a bottom module and an upper member removably attached each to the other with a space defined therebetween;

a plurality of first LEDs embedded in the EHP housing in proximity to the upper member, one or three photodetector units embedded in the EHP housing in proximity to the upper member, an indicator unit embedded in the EHP housing, and a microcomputer embedded in the EHP housing in operative connection between the photodetectors and the indicator unit.

In operation, the microcomputer receives (wirelessly) the boundaries of a strike zone for a particular batter of interest.

Subsequently, an umpire (or other game official) actuates an "ON" ("ARM") button on his/her remote controller unit to activate the LEDs, which, in turn, generate light beams in a predetermined spectrum range. The light beams extend above the EHP housing and diverge in the direction from the upper member of the EHP housing.

Upon delivering a pitch, if the ball crosses through the two beams, the two pulses are detected by the photodetector, and the ratio of the pulse width to the gap between the two pulses determines the height of the ball. If the crossing height is within the strike zone boundaries, the microcomputer actuates the indicator unit to produce a "strike" signal.

If, however, no signal is detected by the photodetector(s), a "ball" condition, i.e., "lateral ball," is declared. In addition, if the crossing height fails to fall between the lower and top boundaries of the strike zone, a "ball" condition is declared as well.

The method also includes the steps of:

determining, by the microcomputer, the time spacing between the crossing events for the first and second light beams, determining, by the microcomputer, a distance between crossing points corresponding to the first and second light beams, and calculating, by the microcomputer, the speed of the baseball passing over the EHP based on the time spacing and the distance.

The method preferably further comprises the steps of:

establishing a wireless communication channel between the EHP and the remote controller unit, and controlling a mode of operation of the EHP by the user by sending commands from the remote controller unit to the microcomputer via the wireless communication channel.

These and other features and advantages of the present invention will be apparent from the following detailed description taken in conjunction with accompanying patent drawings.

DETAILED DESCRIPTION OF THE PREFERRED EMBODIMENTS

Figure 1:
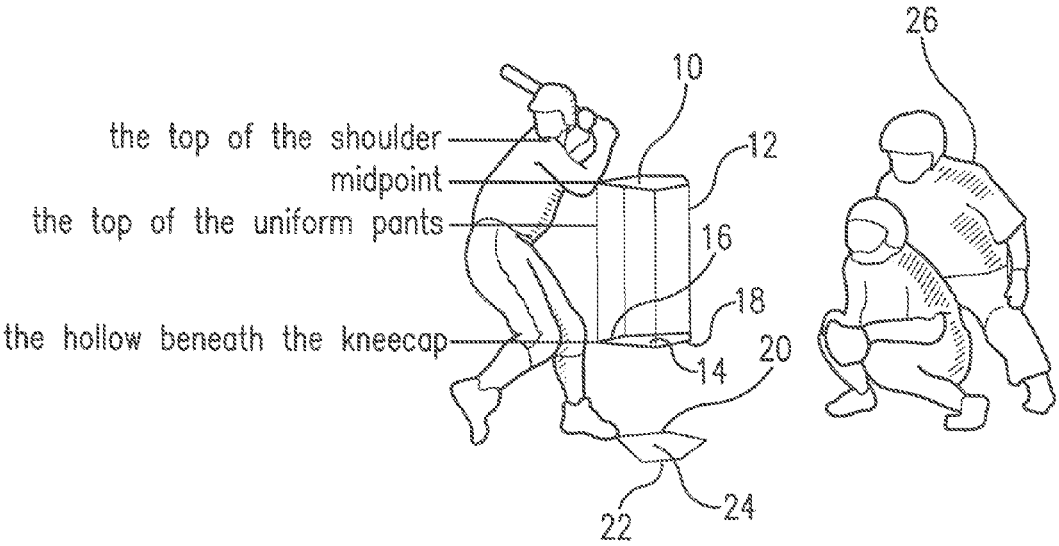
Prior Art FIG. 1
FIG. 1 is a pictorial view demonstrating the strike zone over the home plate of the prior art.

Referring to FIGS. 2-5, there is provided an Electronic Home Plate (EHP) 30 which is a low-cost and effective home plate for baseball/softball game that contains electronic and opto-electronic components adapted for detection and indication of the presence, position, and speed of a baseball passing over home plate.

A further description will be presented herein in correspondence to baseball games. However, the principles and the scope of the invention are fully applicable to other games, such as, for example, softball game.

The electronic home plate is designed to assist umpires in determining if a pitch is a "ball" or a "strike", and may be used in baseball training exercises. Although the subject Electronic Home Plate is envisioned for use in baseball games of both professional and non-professional categories, the subject EHP may be primarily targeted for Little League and scholastic league markets where the umpires are typically non-professional and volunteers.

The EHP also has great value as a training aid for pitchers. The EHP facilitates in obtaining of an XY map of positions and speeds of pitches, i.e., a pitcher can deliver a number of pitches over the EHP and obtain the XY map of where all pitches went, along with the speed of each one.

The EHP 30 is designed to automatically detect a ball 32 as it passes between the outer edges 34, 36 of the home plate 30 which substantially coincide with lateral boundaries 38, 40 of the strike zone 42. The EHP 30 also is configured to automatically calculate the height of the ball passing over the EHP, and to determine if the calculated height falls between top and bottom boundaries 44, 46, respectively, of the strike zone 42 which is adjusted for the height of a batter of interest to correspond to the knee to chest strike zone.

In order to deliver the intended functionality, the electronic home plate 30 is provided with sub-systems embedded into the EHP housing. These include:

- eye-safe light emitters such as, for example, light emitting diodes emitting in near-infrared, or invisible range of spectrum, or possibly solar-blind UV emitters;
- sensitive optical receiver, including one or three photodiodes equipped with electronics for amplification and conditioning of the output signal;
- electronic components including a wireless transceiver (for example, a Zigbee radio), optical signal processing electronics, and a microcomputer, which may be in the form of FPGA (Field Programmed Gate Array);
- a battery, or alternatively, a wired power source;
- a remote controller sub-system for wireless communication with the electronic home plate which has its own transceiver (such as, for example, a Zigbee radio), to produce, transmit and receive wireless signals to/from the transceiver embedded into the electronic home plate, and
- an indication system, which in response to the detection of the ball passing within the boundaries of the strike zone, produces a "strike" signal in optical, audio, wireless or some other format Specifically, as shown in FIGS. 2-5, the EHP 30 is equipped with two rows 48 of light-emitting units 50 generating light beams 52 extending vertically above the EHP. One row (strip of LEDs) 48 is positioned at the front 49 of the EHP, while another row 48 of the LEDs 50 is positioned at the "back" 53 of the EHP where the housing 56 tapers.

Eye Safety in the present system is a major consideration, because LEDs may be the source of eye safety hazard if the LEDs used produce excessive power at certain wavelengths. The EHP uses emitters that are both eye safe and generate sufficient power for the photodetector to detect the signal. Calculations indicate that the satisfactory performance may be attained with LEDs operating in the 800-1000 nm range that satisfy CDRH Class 1 safety standards.

Light emitting diodes 50 are preferably disposed in two rows 48 at the front and back of the housing 56 at the upper member 58 to implement a "picket fence" of light beams 52.

In order to permit the passage of the generated light beams 52 over the upper member 58 of the housing 56, the upper member 58 is formed with slits 91 in alignment with the LEDs 50.

The light beams produced by LEDs 50 should not intersect in order to provide conditions for receipt of two distinct pulses (corresponding to two beams intersection events) when a ball passes through.

During the game, upon the pitch being delivered, if the ball passes through the strike zone 42, then indication will be activated indicating that the pitch is a "strike".

Wireless communication is contemplated between the EHP 30 and officials of the game (such as umpire, scorekeeper, etc.). For this purpose, the official(s) is (are) provided with a remote controller sub-system 54 facilitating control commands and information exchanges with the EHP 30, as well as game results and statistics recordation.

The EHP 30 is envisioned as a standard sized baseball home plate, except for the thickness defined by vertical dimensions of the home plate housing 56, which, as shown in FIGS. 2-3, 5, and 9, contains the necessary electronic components 57 adapted to detect, calculate, and indicate the presence, height and lateral location, as well as the speed of a baseball passing over the EHP 30. The Electronic Home Plate 30 includes the home plate housing 56 which has an upper member 58 and a bottom module 60. The upper member 58 and the bottom module 60 are vertically displaced each with respect to the other to define a space 62 therebetween which contain the electronics 57 of the EHP making the Electronic Home Plate functional.

One or three photodetectors 64 is (are) embedded in the EHP 30 to detect the scattered light 66 incident on the photodetector(s). The optical sensors and amplifiers can respond quickly enough to detect a ball moving up to and in excess of 100 mph.

In order to measure height, only one photodetector (PD) is needed. In order to measure lateral position, three photodetectors are needed. No more than three photodetectors will be required in the EHP, since the FOV (Field-of-View) of these large area PDs is big enough to cover the entire plate area.

The ball must pass through two beams (positioned at the front and back rows 48) in order to measure speed (by the time gap between the peaks of the two pulses, where each peak is found in the detected signal corresponding to the crossing of a respective light beam, and the distance between the beams), lateral position (by the ratio of the peak amplitudes detected by three photodetectors), and vertical position (by the ratio of the second pulse width to the gap between the pulses).

Further, a microcomputer 78, preferably in the form of FPGA (Field-Programmable Gate Array), is embedded in the housing 56 to process data and to perform necessary calculations as will be presented in following paragraphs.

Optical signal processing electronics (also referred to herein as opto-receiver) 80 is embedded in the housing 56 in operative coupling between the photodetectors 64 and the microcomputer 78 to support the functionality of the EHP 30.

The EHP may be powered by a battery 82, or, alternatively, receive wired power.

Figure 4:
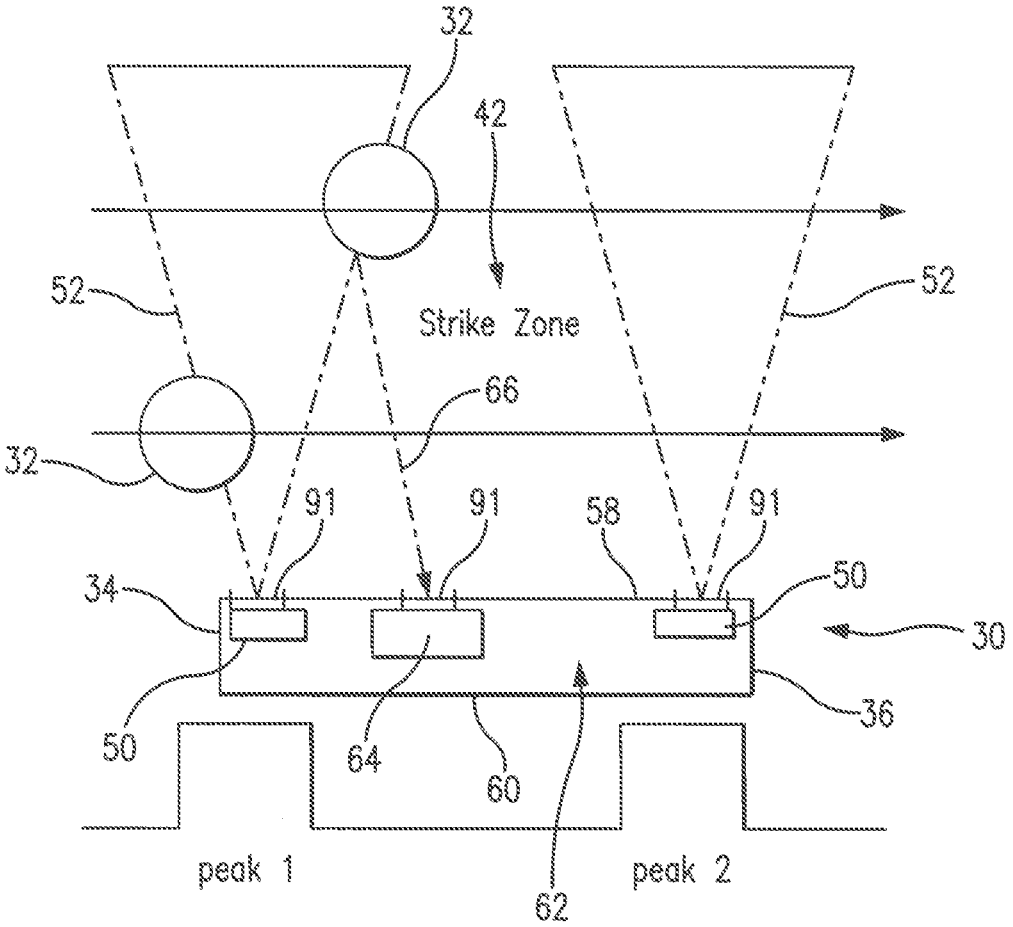
FIG. 4 is a diagram illustrating schematically the diverging light beams extending from the electronic home plate of the present invention with the ball passing over the electronic home plate at different heights.

In the LED array 48, each light beam 52 (as best shown in FIG. 4) is a cone-shaped diverging beam which has a cross section varying in a vertical direction away from the upper member 58 of the housing 56.

Figure 3:
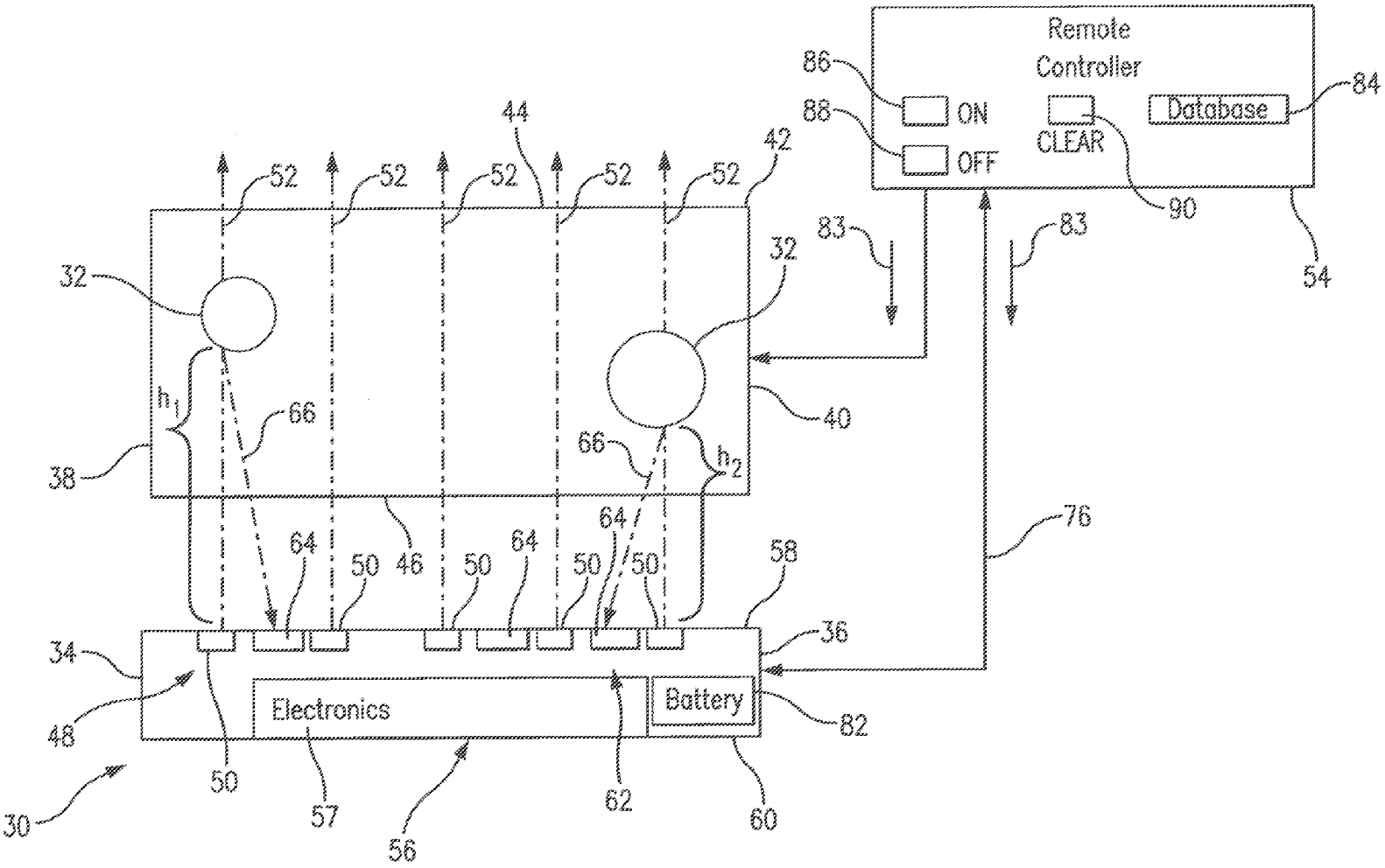
FIG. 3 is a schematic representation of the electronic home plate of the present invention with light beams extending vertically from the upper member.

When the baseball 32 passes through the strike zone 42, it intersects front and rear rows 48 of light beams 52, as shown in FIGS. 3-4. The interaction of the baseball surface with the light beam(s) 52 causes the scattering of the light reflected from the surface of the baseball in multiple directions from the point where the light beam 52 and the baseball 32 intersect.

The detection of the scattered (reflected) light 66 at the photodetectors(s) 64, at certain conditions, activates the indicator system 68 which indicates that a "strike" has been detected.

Figure 5:
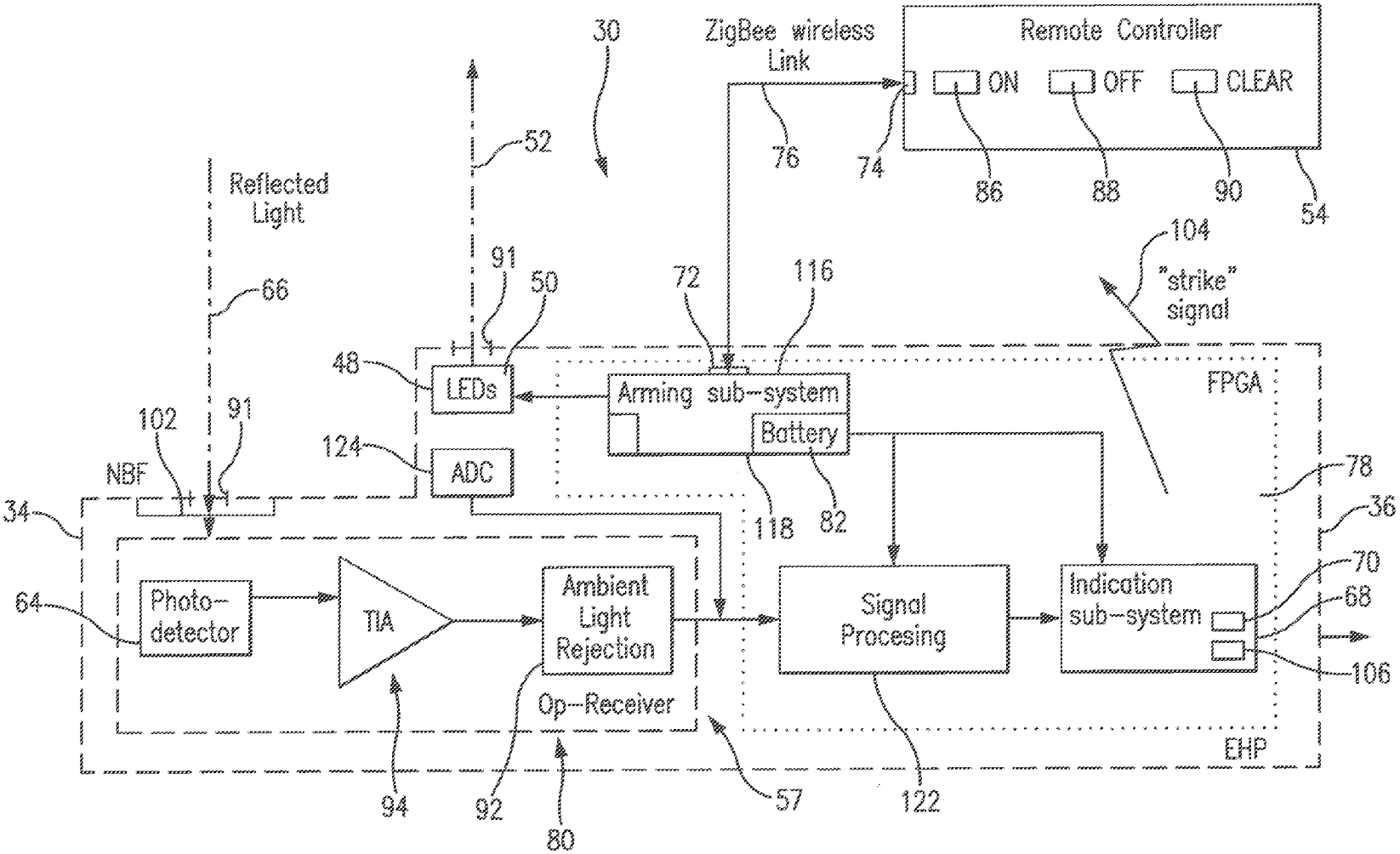
FIG. 5 is a schematic representation of key components of the electronics embedded into the electronic home plate of the present invention.

The indication system 68 in the EHP 30 is contemplated in a number of formats. For example, one or more visible light emitting diodes (LEDs) 70 may illuminate after a "strike" is detected to alert the umpire. Alternatively, wireless signals may be transmitted from the EHP 30 to the remote controller unit 54 of the official umpiring the baseball game. In addition, the "strike" indicator may be in the form of an audiosignal 106 (as shown in FIG. 5) produced in the EHP. It is also contemplated that a cell phone application may be provided to permit cell phone users to see how the pitch qualified ("strike" or "ball") and the location/speed of the pitch.

In order to provide wireless communication between the EHP 30 and the remote controller unit 54 in possession of the umpire, a transceiver 72 is embedded in the EHP housing 56, and a transceiver 74 is included in the controller unit 54 to communicate commands and data therebetween through a communication channel 76. The transceivers may be implemented, for example, as wireless transceiver used in Zigbee radio.

In order to declare a "strike", two positional conditions are to be met:

(a) a lateral "strike" is to be determined, i.e., the baseball has to pass and be detected over the home plate between its side edges 34, 36, and (b) the height of the passing ball has to fall between the top and bottom boundaries 44, 46 of the strike zone 42.

Figure 2:
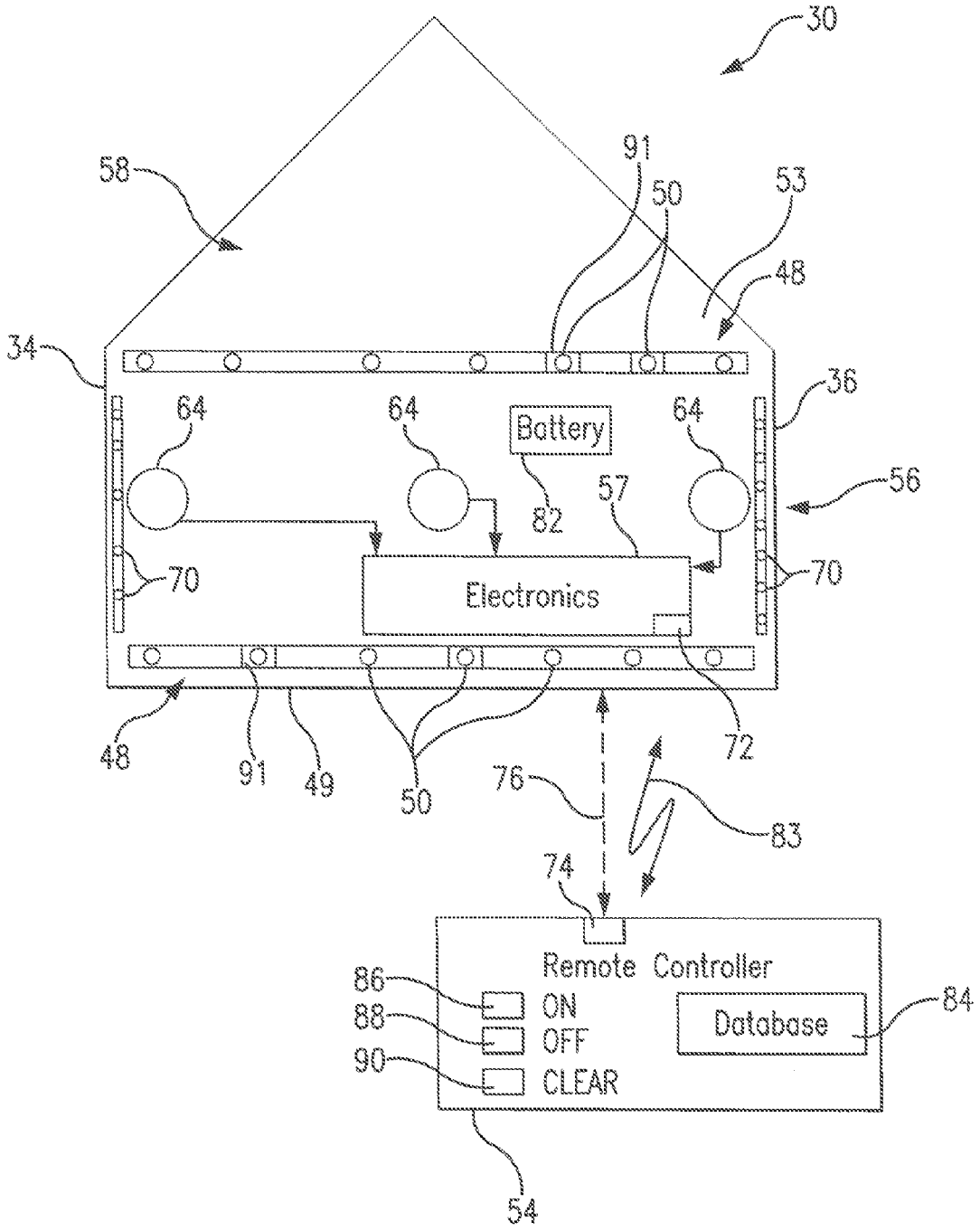
FIG. 2 is a schematic representation of the system of the present invention showing the electronic home plate layout and wireless connection to a remote controller unit.

As shown in FIGS. 2, 3, and 5, the remote controller unit 54 is provided with the "ON", "OFF", and "CLEAR" buttons 86, 88, and 90, respectively. A scorekeeper, or a person of similar authority, actuates the ON button 86 provided on the controller unit 54 in order to activate the home plate 30 prior to each pitch delivered in order that bat movements over the home plate do not produce unwanted alerts.

An alarm sub-system 116 (shown in FIG. 5), upon receipt of the ON command from the remote controller, is activated, and, in turn, activates the FPGA (microcontroller) 78 (which "idles" until the ON signal is received thereat from the remote controller). The photoreceiver (photodetector) is ON constantly regardless of the state of the arming sub-system.

The arming sub-system 116 has an LED power supply 118, wireless connection/controller (transceiver 72) with the remote controller 54, and a wired controller (not shown) to the Ethernet port for cabled connection to the EHP.

The arming sub-system 116, along with the indication sub-system 68, and signal processing algorithm 122, are contemplated as parts of the FPGA module 78.

The primary purpose of the alarm sub-system 116 is to save the battery power so that the LEDs are only turned ON when a pitch is about to be delivered. It also prevents the EHP from errors associated with calculating random motions over the EHP, for example, random swings of the batter's bat.

The ability to activate/deactivate the home plate device permits conservation of battery power when the electronics and emitters may be put in a "sleep" mode. Once the electronic home plate is ON, any movement across the home plate, including an uncontrolled swing of the bat produced by the batter, will be detected by the photodetector(s) 64 and produce a signal indicating a lateral strike. In order to prevent the false "strike" signal, the umpire activates the home plate device immediately prior to the delivery of the pitch so that bat movements over the home plate do not give unwanted alerts.

When the game starts, the scorekeeper (or other authority) uses the CLEAR button 90 to turn off the illumination system immediately before the pitcher is to deliver the first official pitch of the game. For the rest of the game, just before the pitcher is to deliver the pitch, the scorekeeper will CLEAR the LEDs. When the game ends, the scorekeeper turns OFF the system by actuating the OFF button 88 on the remote controller unit 54.

The official may use a cell phone/tablet/laptop/desktop to switch the electronic home plate between the ON/OFF and CLEAR modes of operation and to communicate information between the control unit and the EHP 30.

Prior to beginning of the game, the umpire (or another game official) is provided with the ability to remotely adjust the strike zone parameters (by selecting a jersey number of the player) that activates an indication once the baseball is in the vertical strike zone, i.e. that the detected height at which the baseball crosses the light beams 52 falls between the top and the bottom boundaries 44, 46 of the strike zone 42.

In operation, the umpire (or other game official) sends a wireless signal 83 through the communication channel from the controller unit 54 to the EHP 30 to provide the microcomputer 78 with parameters of the strike zone corresponding to a particular height of a next batter (batter of interest) in the game.

A database 84 of the strike zone parameters is available to the umpire (or other game official). The database 84 may reside in the remote controller 54.

Prior to a season, all eligible players have their strike zones measured and stored in a computer which the scorekeeper (or umpire, or other game official) uses as his/her remote controller, or connected thereto. Before the pitch, the umpire (or scorekeeper) actuates the remote controller to select from the database 84 the jersey number of the player of interest. The parameters (top and bottom boundaries) of the strike zone corresponding to the jersey number of the player of interest are thus transmitted to the EHP 30, particularly, to the microcomputer 78 before the game, for further calculations, as will be presented in detail in following paragraphs. The microcomputer 78 does not keep this information after the game is completed.

In order to attain a precise detection of the ball position relative to the boundaries of the strike zone, an important design consideration is to provide the amount of scattered light 66 from a baseball 32 intersecting a light beam 52 which can be easily detectable by the photodetectors 64 even in ambient light conditions.

If the light emitter power is P (W), and the baseball intersects a fraction f of the beam 52, then the light scattered is described as fW, which likely corresponds to the Lambertian distribution over a hemisphere.

If the photoreceiver (photodetector) 64 has a collection area A, the power detected from a baseball crossing the light beams at a height of h (m) (for example, $h_1$ and $h_2$ shown in FIG. 3) is $$P_{RX} = \frac{fPA}{2\pi h^2} \quad \text{(Eq. 1)}$$

The present system is designed so that any baseball passing over the strike zone 42 intersects one or more emitter beams 52. For example, for a 1 mW emitter, f=100%, h=1 m, and a photoreceiver collection area of 100 $mm^2$, the received power is approximately 16 nW. This signal may be detected as an electrical pulse whose length depends on the speed of the baseball and its diameter (~74 mm).

As an extreme example, a 100 mph fastball would give a pulse length of approximately 1.7 ms. Therefore the detection bandwidth of the receiver needs to be on the order of 10 kHz.

Typical photoreceivers have a noise equivalent power on the order of $10^{-13}$ W/√Hz, and thus are capable of detecting $10^{-11}$ W a bandwidth of 10 kHz. These considerations provide a signal-to-noise ratio for the example calculations of 1600, and establishes the feasibility of the proposed scheme.

The optical sensors and amplifiers can detect the reflected emitter light in the presence of bright sunlight or baseball park night lights. Ambient light is not modulated and is also largely rejected by the DC photocurrent offset (such as a ambient light rejection) circuit 92 coupled after the transimpedance amplifier 94, as shown in FIGS. 5 and 6A-6B.

To avoid problems with possible direct sunlight incident on the EHP surface, it is contemplated that, the optical receiver 80 includes an optical receiver circuit (such as, for example, a transimpedance amplifier (TIA) 94) AC-coupled into the restoration circuit (also referred to herein as the DC photocurrent offset, or the ambient light reflection, circuit 92) that will offset the photocurrent generated in the photodetectors by sun exposure, which is several orders of magnitude higher than the signal corresponding to the scattered light 66 reflected from the baseball passing o per the EHP. A narrow band filter is also employed to block out all light outside of the emission spectrum of the LEDs. The LED wavelength was also chosen to coincide with an oxygen absorption band in the atmosphere, so solar irradiance at this wavelength is approximately four times less than nearby ones.

As shown in FIGS. 5, 6A-6B, and 8, the optical receiver circuit (TIA) 94 is coupled to the output of the photodetector(s) 64 to electrically amplify and condition the electrical current produced by the photodetector which is the result of conversion of the optical signal incident on the photodetector 64 into the electrical current. FIGS, 6A.-6B illustrate two examples of a number of possible implementations of the circuit schematic for the optical receiver circuit 94, functioning as a detection, amplification, and conditioning circuit, and the restoration circuit, i.e., the ambient light rejection circuit 92. It is understood that other alter native schematics also are contemplated for the EHP 30 for the purposes of amplification and conditioning of the signal, as it as for the ambient light rejection.

Figure 6A:
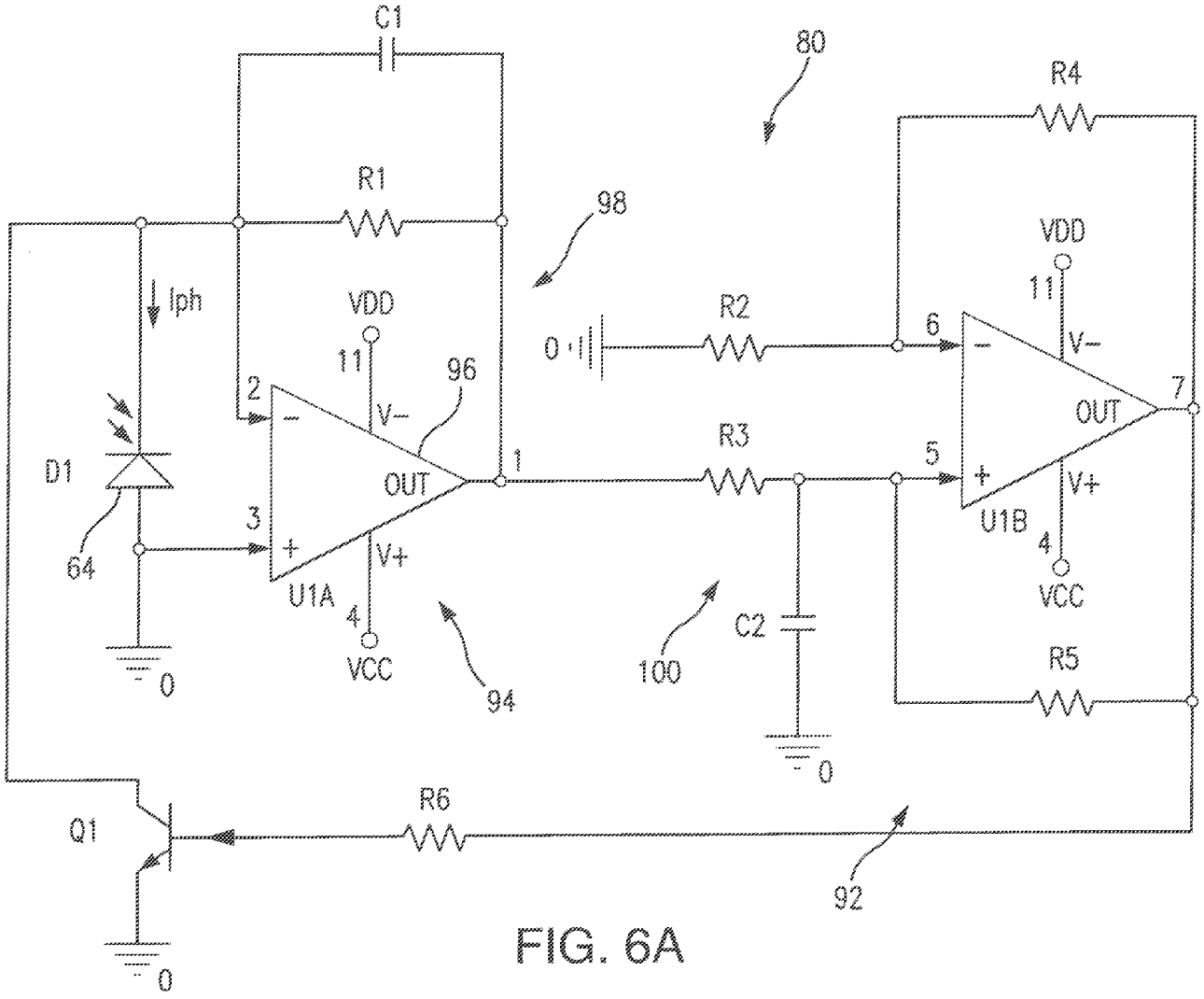
FIGS. 6A and 6B are schematic diagrams of alternative embodiments of the circuitry for detection, amplification and conditioning of the light signal, as well as for ambient light rejection, in the electronic home plate of the present invention.
Figure 6B:
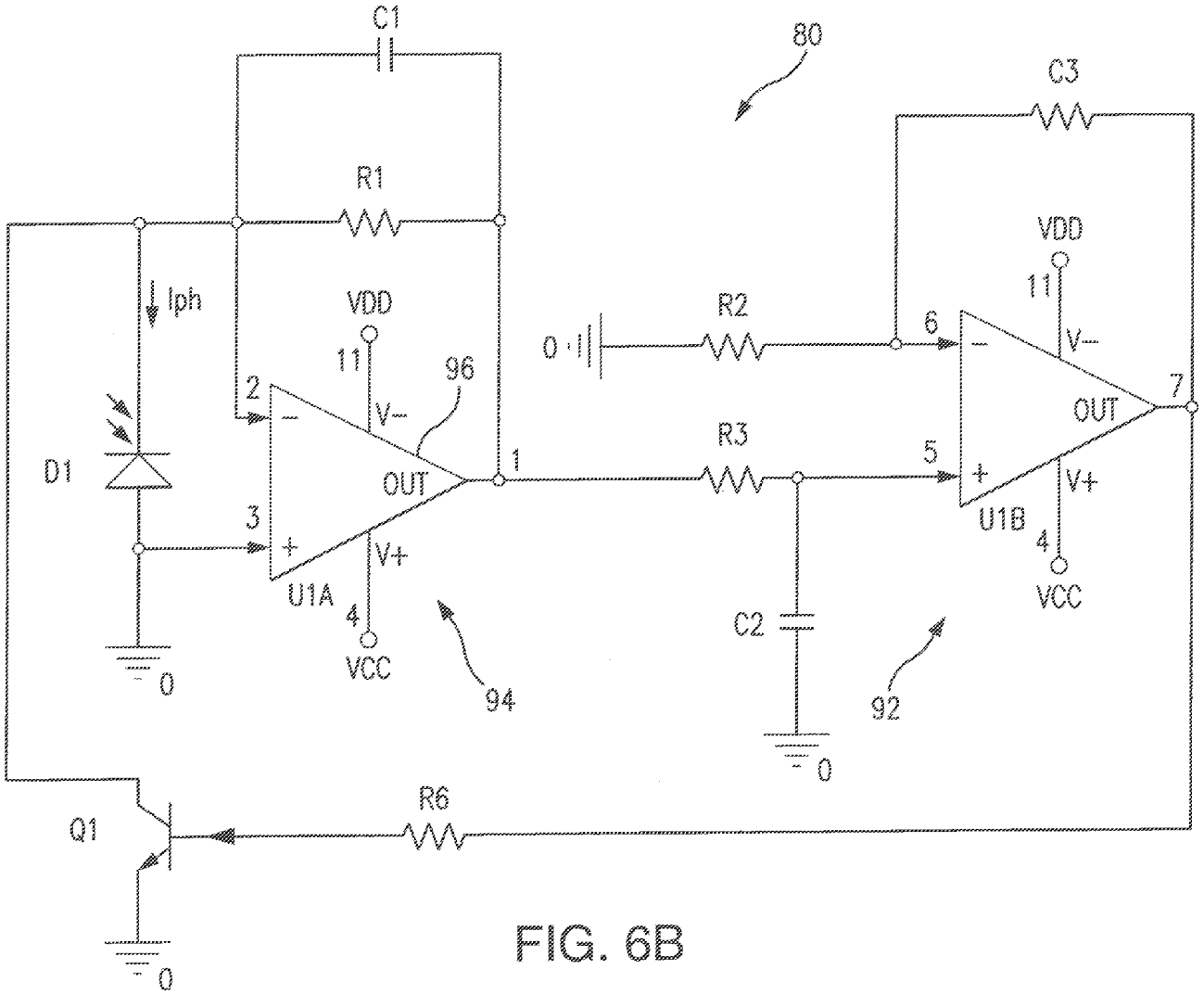

As shown in FIG. 6A, the optical receiver 80 includes the following components:

$D_1$ is a large area Si photodiode;

U1A is a transimpedance amplifier op-amplifier;

$R_1$ is the transimpedance amplifier gain resistor;

$C_1$ is the transimpedance amplifier stability capacitor;

$R_2$-$R_5$ are non-inverting integrator feedback resistors;

$C_2$ is a non-inverting integrator time constant set capacitor; and $V_{cc}$ and $V_{DD}$ are positive and negative power supplies, respectively.

The ambient light rejection circuit 92 is represented by non-inverting integrator op-amplifier U1B with resistors $R_4$, $R_5$, which is coupled by its output (node 7) to the photodetector $D_1$ through the feedback resistor $R_6$ and NPN BJT DC offset adjust transistor Q1.

FIG. 6B is an example of an alternative circuitry of the optical receiver 80, where the feedback on the ambient light rejection circuit is made capacitive (C3). This circuit implementation is beneficial in better stability and other enhanced performance characteristics in conditions where the photodetector is exposed to overly intensive (strong and quick) light source.

In operation, the photodiode 64 generates a photocurrent $I_{ph}$ whenever an optical signal 66 is incident at the photodetector 64 surface. By reverse biasing the photodiode 64, the photodiode's depletion capacitance can be reduced. U1A/$R_1$/$C_1$ converts the photocurrent $I_{ph}$ into a proportional voltage. $C_1$ is a feedback capacitor that helps maintain stability around the feedback loop 98. $R_1$ is the feedback resistance and its value determines the magnitude of the amplification. Due to the fact that the op-amp 96 (U1A) has a narrow bandwidth, it also acts as a low-pass filter. The combination of this "internal" low-pass filter with the external high-pass filter 100 (formed by the $R_1$ and $C_2$) provides sufficient signal conditioning.

A suitable photodetector 64 may be in the form of a Silicon p-i-n photodiode for the receiver, for example, the Model FDS10×10 manufactured by Thorlabs. This photodetector has a relatively large area of 10×10 $mm^2$ and is rated to have a terminal capacitance of 380 pF at a 10 V reverse bias. The photodiode generates a photocurrent, from an incident optical signal 66 by $$I_{ph}=R_{\lambda}*P_{in}*A_{Rx} \quad \text{(Eq. 2)}$$

where $R_{\lambda}$ is the detector's responsivity which is wavelength dependent. It provides a measure of the amount of current generated per watt of incident power, $P_{in}$, on the detector's surface area, $A_{Rx}$. Specifically, $$R_{\lambda}=\eta e/hv \quad \text{(Eq. 3)}$$

where $\eta$ is the quantum efficiency of generating an electron-hole pair per incident photon, e is the charge of an electron, and the product term hv is the energy of the incident photons.

The spectral response ranges from 700 nm to 1100 nm. The photodiode 64 has a peak responsivity of 0.62 A/W at 960 nm, which is satisfactorily close to the 940 nm LED wavelength that the EHP may use. Photoreceivers are contemplated to be equipped with suitable filters to reject most unwanted ambient signals.

The U1B in the restoration circuit 92 is a non-inverting integrator with a long time constant to output a current proportional to the DC light level output by the U1A. The current produced by the non-inverting integrator op-amplifier U1B is amplified by the transistor $Q_1$, to produce the offsetting current supplied to the photodetector $D_1$ to counteract the current produced by the photodetector to remove the DC bias from the ambient light.

Figure 7:
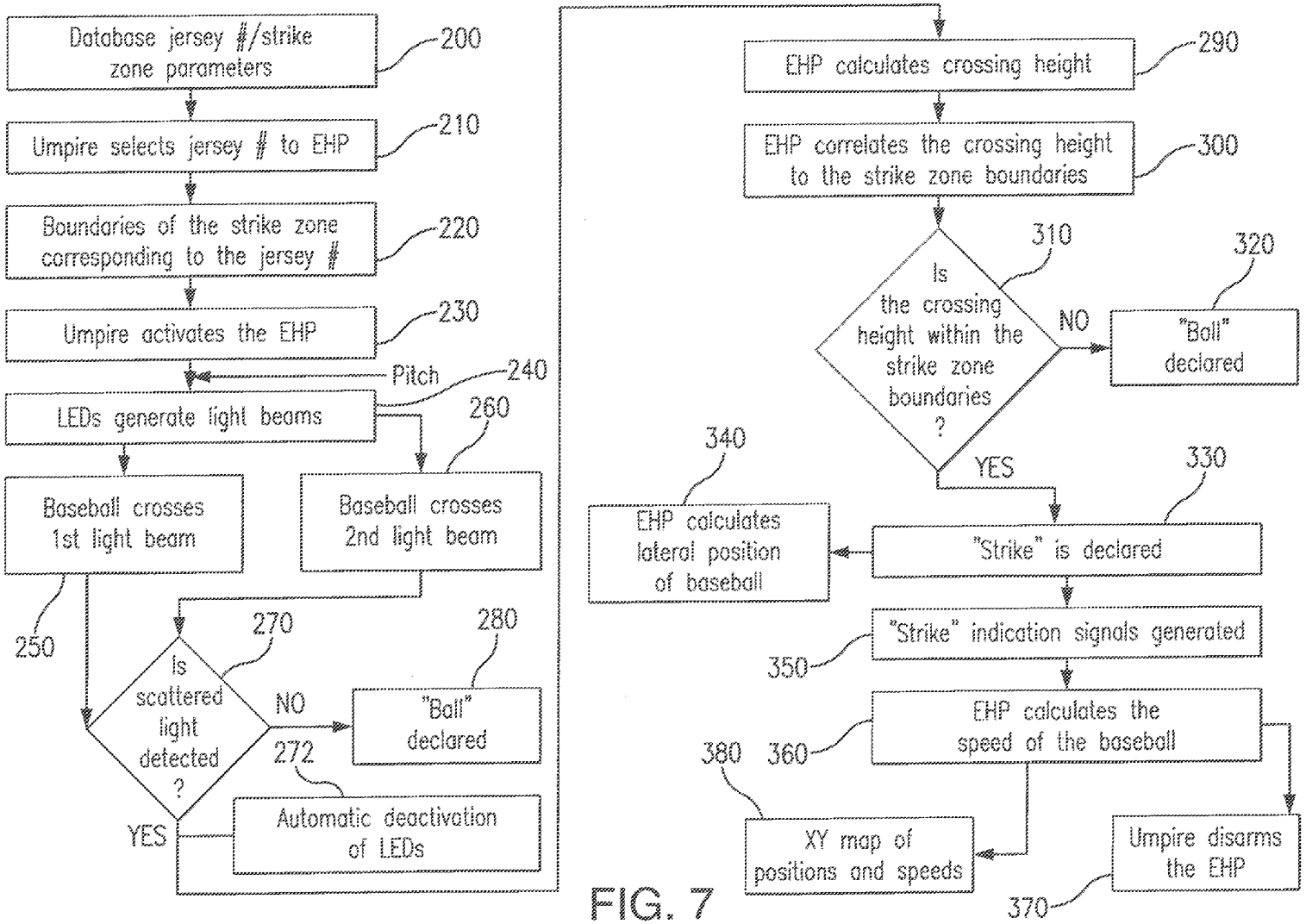
FIG. 7 is a flow chart diagram of a process for automatic determination of position and speed of baseball of the present invention passing over the home plate of the present invention.

Miniature optical transceiver 72 is used in the present system which may incorporate a 940 nm LED 50 and the photoreceiver 94, along with a microcontroller (microcomputer) 78 for signal processing as shown in FIGS. 5 and 7. The total power consumption of this system is less than 5 W.

As shown in FIG. 5, the scattered light 66 from a baseball reaches the photodetector(s) 64 via a narrow band filter (NBF) 102. The umpire "arms" the strike indication electronics 68 by the lower power Zigbee wireless system 54. An optical pulse corresponding to the determination of a strike triggers the illumination of the LED strike indicator lights 70.

The LEDs 70 in the indicator sub-system 68 may be in the form of LED tape strips attached to the upper member of the housing, for example at the side edges of the plate, as shown in FIG. 2.

Alternatively, other forms of the strike indication are contemplated, such as, for example, wireless signal 104, or audio signal 106.

Referring to FIG. 7 which is a flow chart diagram of the automatic determination of a "strike" provided by the underlying functionality of the electronic home plate of the present invention, the process is initiated in step 200 where the umpire uses the remote controller to select a jersey number of a batter of interest from the database 84 of all eligible players in step 210. Subsequently, the empire transmits the strike zone parameters of the batter of interest to the EHP in step 220.

Subsequently, in step 230, the umpire actuates the ON switch on the remote controller in order to activate (Arm) the EHP just before the pitch is delivered.

The activated FPGA turns ON the LEDs in step 240 and "waits" for the receipt of a first pulse from a photodetector.

The pitched ball passes over the EHP and crosses one light beam in step 250 at a corresponding crossing height. In addition, the baseball may cross another light beam in step 260. The light reflected from the surface of the baseball crossing the light beams is scattered and is incident on the surface of the photodetector(s) so that the photodetectors detect the scattered light and produce an electrical current corresponding to the optical signal incident on the photodetector. The logic further flows to logic block 270 to determine if the scattered light was detected.

If the scattered light was not detected at this time, the logic flows to block 280 where the "ball" is declared meaning that the delivered pitch did not result in the baseball passing over the home plate between the lateral boundaries 38 and 40 of the strike zone.

If, however, in logical block 270, it was determined that the scattered light was detected (the indication of the "lateral" strike), the logic flows to block 290 where the microcomputer 78 calculates the crossing height of the baseball.

The height of a pitch is determined as shown schematically in FIGS. 3-5. The LEDs 50 produce the "picket fence" light beams 52 whose width varies as a function of height. A ball 32 that passes through the cone-shaped beams 52 produces a scattered light signal 66 versus time that has a different mark/space ratio for balls at different heights. The microcomputer makes the calculations based on readings of the photodetector(s) corresponding to crossing of two beams (at the front and back rows 48) by the ball.

In order to calculate the height of the baseball, the signal processing software 122 (shown in FIG. 5) uses the time ratio between the time gap between consecutive pulses (peaks) detected by the photodetector(s), corresponding to crossing of two light beams, and the width of the second pulse (peak).

From step 290, the logic passes to step 300 where the microcontroller 78 correlates the calculated crossing height to the boundaries of the strike zone, specifically to the top and bottom boundaries 44, 46 of the strike zone.

Information further passes to logical block 310 where the determination is made whether the calculated crossing height falls between the strike zone's top and bottom boundaries 44, 46. If the calculated height(s) is (are) not inside the parameters of the strike zone, the logic flows to block 320, where a "ball" is declared.

If, however, in step 310 the calculated height is found between the top and bottom boundaries of the strike zone, the "strike" is declared in step 330, and the logic further flows to step 350 where the "strike" indication signal is generated.

In this instance, the indication system 68 actuates the "strike" signal, either in the form of visible lights, audio signal, wireless signal, or uses a cell app for cell users to see the results, etc., depending on the design of the system.

The light and audio signals are easily noticeable by the umpire (or other officials). A wireless "strike" signal is transmitted from the transceiver 72 of the EHP to the transceiver 74 of the remote controller to alert the umpire (or other official) that the pitch resulted in a "strike".

After two pulses are detected, logic may calculate "lateral" position of the baseball for example, for training aid purposes. The "lateral" position is calculated in step 340 by the signal processing software 122 (shown in FIG. 5) by the ratios at the peak amplitudes of the signals received from three photodetectors.

In order to calculate the speed of the baseball passing over the home plate, in step 360 the microcontroller calculates the speed of the baseball based on the time difference between detection of the first and second scattered light signals peaks as the ball crosses the first and second light beams in steps 250 and 260.

Specifically, when the ball passes through two light beams, the photodetector "sees" two peaks when the ball is directly above the corresponding LED slit 91 (shown in FIGS. 2, 4, 5, and 9). Since the spacing between the centers of the two slits is known, in order to calculate the speed, the microcomputer divides this distance by the time spacing between two signal peaks which is measured by a sampling ADC (Analog-Digital Converter) 124 (shown in FIGS. 5 and 8). The peaks of the two signals of interest are defined by the FPGA code.

Upon the "strike" being determined and indication of the "strike" generated, the umpire actuates the OFF button 88 on the remote controller to deactivate the EHP in step 370 until the next pitch is delivered.

The LEDs in the home plate may be deactivated automatically in step 272, either after the pitch is detected or after a set time period since the LEDs' activation in order to minimize power consumption.

In addition, in step 380, the EHP can produce an XY map of positions and speeds of delivered pitches as a training aid tool.

Figure 8:
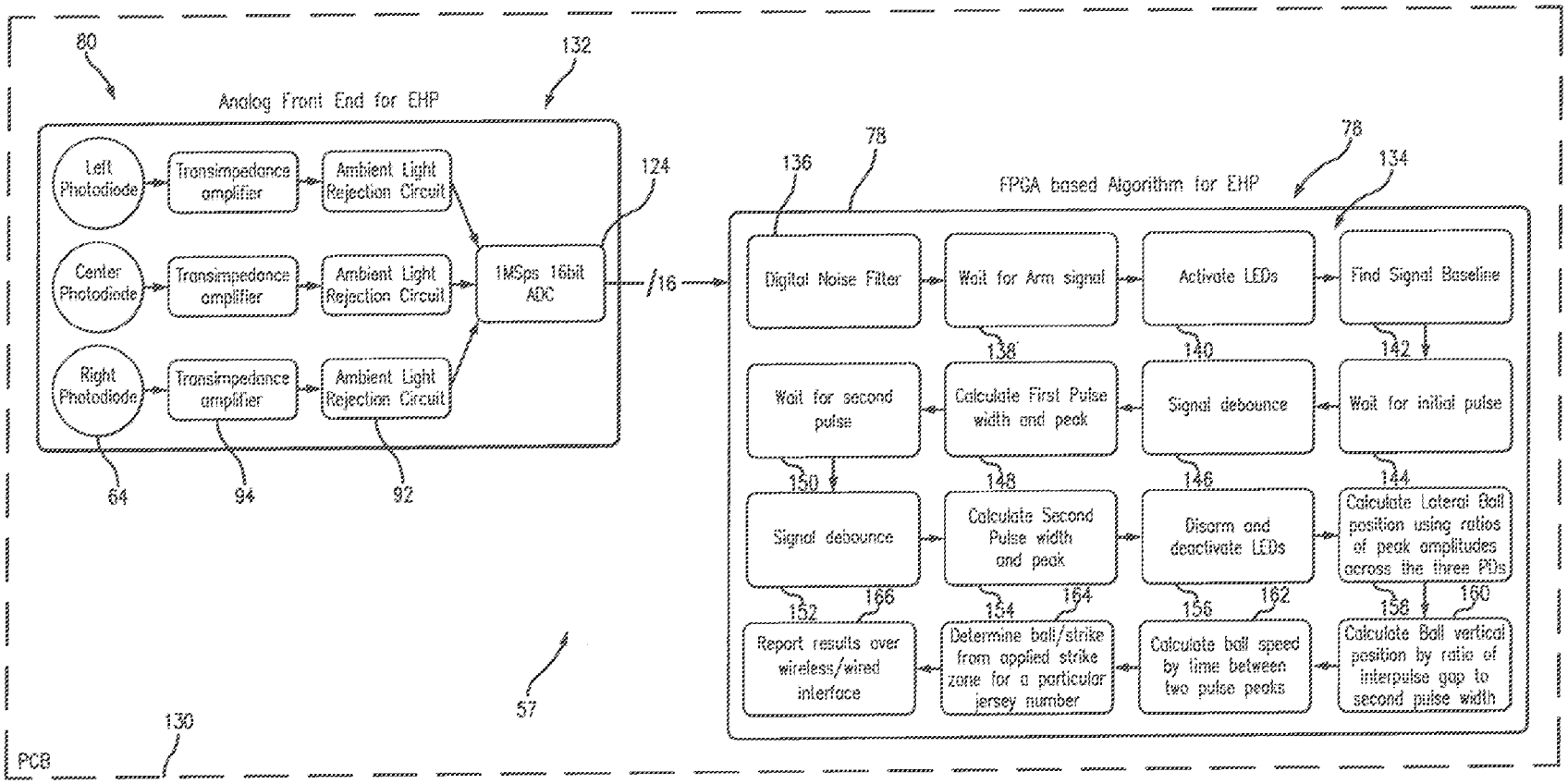
FIG. 8 is a representation of the Analog Front End and the FPGA based algorithm of the electronics embedded in the electronic home plate of the present invention.

Referring to FIG. 8, a PCB (Printed Circuit Board) 130 is schematically shown at which the FPGA 78 and the analog front end 132 for the EHP 30, as well as the ADC 124 reside.

The analog front end 132 for the EHP 30 contains the photodetectors supplying the output signal to the transimpedance aamplifiers 94 followed by the ambient light rejection circuitry 92. From the output of the optical receiver 94 (also shown in FIGS. 5 and 6), the signals are applied to the ADC 124 in analog form and is output by the ADC 124 in a digital format to the FPGA 78 which operates in correspondence with the algorithm 134.

As shown in FIG. 8, the FPGA applies a digital noise filter 136 to the signal(s) received from the analog front end 132 of the EHP circuit. In subsequent block 138, the FPGA waits for the "Arm" signal, and activates LEDs in block 140 once the "Arm" (ON) signal is received from the remote controller actuated by the umpire (or other game official).

Upon the LED's production of light signals, the FPGA in block 142 finds the signal baseline, and the logic flows to block 144 where the FPGA waits for initial pulse arrival.

Upon the initial pulse being received, the logic flows to block 146 for signal debouncing and calculates the first pulse widths and peak in block 148.

Upon calculation the parameters of the initial debounced signal in block 148, the logic flows to block 150 and waits for a second pulse to arrive. When the second pulse is received, the logic debounces the signal in block 152 and calculates the second pulse width and peak in block 154.

When both signals are processed in blocks 148 and 154, the FPGA disarms and deactivates the LEDs in block 156 in order to save battery power. The LEDs are only actuated when a pitch is imminent, and all calculations are performed with the LEDs deactivated.

From block 156, the logic follows to block 158 where the FPGA calculates a lateral ball position using ratios of the detected peak amplitudes (for two light beams crossings) across three photodetectors. The logic further calculates ball vertical position (height) in block 160 by the ratio of the inter-pulses gap to the second pulse (peak) width.

Further, in block 162, the FPGA calculates ball speed by the time gap between two pulse peaks and the distance between slits in the top member of the EHP housing corresponding to the two light beams being crossed.

From block 162, the algorithm passes to block 164 where the logic determines ball/strike for the strike zone parameters adjusted for a particular jersey number of the batter of interest. Upon determination whether a pitch can be qualified as a "strike" or a "ball", the logic flows to block 166 where the results are reported over wireless (or wired) interface to the remote controller.

Figure 9:
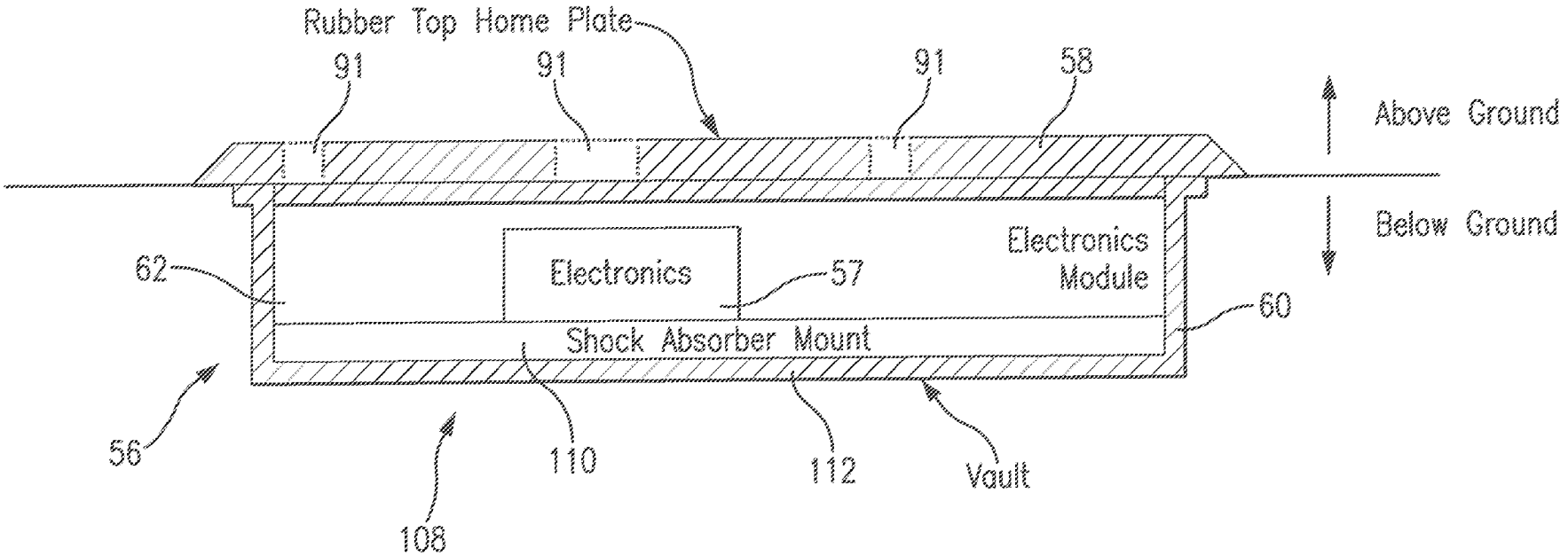
FIG. 9 is a schematic representation of the housing of the electronic home plate of the present invention provided with the shock absorbing mechanism.

Referring to FIG. 9, the EHP electronics, emitters, and photodetectors are housed behind small IR transparent windows (slits) 91 that are flush with the top member 58 of the EHP housing 56. The components beneath the top plate 58 are mounted within the bottom electronics module 60.

A shock absorbing mechanism 108 is provided in the housing 56 to withstand mechanical stress and shocks from balls, bats, and players hitting the EHP 30. The shock absorbing is carried out through forming the bottom module 60 as a removable module housing the electronics in the space 62. The removable module 60 is plugged through a shock absorber mount 110 into a resin vault 112 mounted in the ground. The stress will be directed around the electronics and optics into the ground. The rubber top member 58 is attached to the module 60.

It is envisioned that the housing 56 of the EHP circuit has the dimensions of a standard sized baseball home plate, except for the thickness, that will be defined by the dimensions of the space 62 in the module 60 to accommodate all the necessary electronics 57 to detect and indicate the presence of a baseball passing over the home plate through the strike zone.

In fabrication of the subject electronic home plate, a mold may be manufactured similar to the conventional home plate except it is thicker with indentations 91 on the top surface 58. The light emitting diodes with clear lenses are snapped into the indentations 91 made in the top member 58. A receiver (photodetector), electronic components and a battery is assembled in the removable module 60 which subsequently will be attached to the top member 68. Alternatively, the photodetector with electronic components and the battery may be attached to the module 60.

The emitters and sensors must operate in the presence of rain, dust and mud. This may require the umpire to clean the top of the EHP periodically, which is done by the umpire even on standard prior art home plates.

The electronic home plate is a product that may be used as an assistant to an umpire to judge whether the pitch resulted in a "ball" or "strike" in a professional baseball game, as well as in youth, scholastic and collegiate baseball and softball leagues. The electronic home plate automatically detects the ball as it passes between the outer edges of the home plate and calculates the height of the ball.

If the ball passes through the strike zone, i.e. between the outer edges of the home plate and at the height falling between the top and bottom boundaries of the strike zone, then strike signal will be activated indicating that the ball was a strike. The indication signal may be in the form of lights, audio signals, wireless signals, cell app. etc.

The EHP system is programmed to automatically calculate position of the ball relative to the strike zone boundaries which are adjusted for each batter as provided by an official. A database of strike zones measured for eligible players may reside at the remote controller unit controlled by the umpire or other official.

A wireless communication is available between the electronic home plate and remote controller of the official to communicate control commands and information therebetween. Controller unit is equipped with "ON" (Arm), "OFF", and "CLEAR" buttons so that the official can wirelessly actuate electronics and light emitters in the electronic home plate, and deactivate the system when desired.

Although this invention has been described in connection with specific forms and embodiments thereof, it will be appreciated that various modifications other than those discussed above may be resorted to without departing from the spirit or scope of the invention as defined in the appended claims. For example, functionally equivalent elements may be substituted for those specifically shown and described, certain features may be used independently of other features, and in certain cases, particular locations of the elements may be reversed or interposed, all without departing from the spirit or scope of the invention as defined in the appended claims.

What is being claimed is:

1. An Electronic Home Plate (EHP) system, comprising:

an EHP housing including a bottom module and an upper member attached to said bottom module and defining a space therebetween;

a plurality of first light emitting units embedded in said EHP housing at predetermined positions in proximity to said upper member thereof, each of said first light emitting units generating a light beam extending vertically above said upper member of said EHP housing, thereby forming a plurality of vertical light beams spaced apart a predetermined distance one from another, wherein a cross-section of said light beam varies therealong in a predetermined fashion;

an optical signal processing unit including:

at least one photodetector unit embedded in said EHP housing in proximity to said upper member thereof for detecting an incident optical signal thereon, wherein the incident optical signal includes a scattered light signal produced as a result of interaction of a ball with at least one vertical light beam from said plurality of first light emitting units thereof, and wherein said at least one photodetector unit produces an output electrical signal corresponding to said optical signal incident thereon, an optical receiver circuit operatively coupled to an output of said at least one photodetector unit to amplify and condition said output electrical signal, and an ambient light rejection unit operatively coupled to said optical receiver circuit and configured to remove from the amplified and conditioned output electrical signal an ambient light photocurrent generated by said at least one photodetector unit in response to an ambient light incident thereto; and a microcomputer unit embedded in said EHP housing and operatively coupled to said plurality of first light emitting units and said optical signal processing unit, said microcomputer unit being configured to determine passage of a ball within boundaries of a predetermined strike zone above said EHP housing based on readings of said output electrical signal generated at said at least one photodetector unit.

2. The EHP system of claim 1, further comprising an indicator unit embedded in said EHP housing and operatively coupled to said microcomputer unit, said microcomputer unit actuating said indicator unit to produce a strike signal when said ball passes within said strike zone boundaries.

3. The EHP system of claim 2, wherein said indicator unit includes a plurality of second light emitting units embedded in said EHP housing in proximity to said upper member thereof and emitting visible light.

4. The EHP system of claim 2, wherein said indicator unit generates an audible signal.

5. The EHP system of claim 2, wherein said indicator unit produces said strike signal for wireless transmission to a destination transceiver.

6. The EHP system of claim 1, wherein said at least one photodetector unit detects said scattered light signals reflected from the ball crossing two of the plurality of spaced apart vertical light beams at a respective crossing height along each of said plurality of vertical light beams, wherein said microcomputer unit is further configured to calculate said respective crossing height in accordance with the power of said reflected light signals detected by said at least one photodetector unit, and to determine whether said crossing height falls within a top and a bottom boundaries of the strike zone.

7. The EHP system of claim 1, wherein said plurality of vertical light beams diverge in the direction from said upper member of said EHP housing.

8. The EHP system of claim 1, wherein said plurality of first light emitting units generate light in a spectrum range covering a range selected from a group consisting of: invisible and infrared, and wherein said spectrum range coincides with an oxygen absorption found in the surrounding atmosphere to attain a reduced solar irradiance in said spectrum range.

9. The EHP system of claim 8, wherein said plurality of first light emitting units include Light Emitting Diodes.

10. The EHP system of claim 1, wherein said plurality of first light emitting units is disposed along a periphery of said upper member of said EHP housing.

11. The EHP system of claim 6, wherein said plurality of first light emitting units are arranged into a front row and rear row of the plurality of first light emitting units, said front row and said rear row being spaced apart along a longitudinal direction of said EHP housing, and wherein said microcomputer unit is further configured to determine time spacing between detection of the reflected scattered light signals corresponding to said two of said plurality of vertical light beams crossings by the ball, wherein one of said two spaced apart of said plurality of vertical light beams is generated by a respective first light emitting unit in said front row, and another of said two of said plurality of spaced apart vertical light beams is generated by a respective said plurality of first light emitting unit in said rear row, and to calculate a speed of the ball passing over said EHP based on said time spacing and distance between said two spaced apart vertical light beams.

12. An Electronic Home Plate (EHP) system comprising:

an EHP housing including a bottom module and an upper member attached to said bottom module and defining a space therebetween;

a plurality of first light emitting units embedded in said EHP housing at predetermined positions in proximity to said upper member thereof, wherein said plurality of first light emitting units are arranged in a front row and a rear row of said plurality of first light emitting units, said front and rear rows being spaced apart along a longitudinal direction of said EHP housing, and wherein each of said plurality of first light emitting units generates a light beam extending vertically above said upper member of said EHP housing;

at least one photodetector unit embedded in said EHP housing in proximity to said upper member thereof;

a microcomputer unit embedded in said EHP housing and operatively coupled to said plurality of first light emitting units and said at least one photodetector unit, said microcomputer unit being configured to determine passage of a ball within boundaries of a predetermined strike zone adjustably defined above said EHP housing based on readings of said at least one photodetector unit;

a remote controller unit adapted for wireless communication with said microcomputer unit of said EHP for controlling operation thereof;

a wireless communication channel coupled between said remote controller unit and said EHP; and a switch operatively coupled to said microcomputer unit and controlled by a user via said remote controller unit to switch the EHP between ON and OFF modes of operation.

13. The EHP system of claim 12, further comprising a database of strike zone parameters of a plurality of players stored in said remote controller unit for a user to select respective strike zone parameters for a player of interest, wherein said remote controller unit is configured to send a signal corresponding to said selected respective strike zone parameters of interest to said microcomputer unit via said wireless communication channel, and wherein said microcontroller is further configured to adjust said strike zone parameters in correspondence to said respective strike zone parameters subsequently to receipt of said signal from the remote control unit.

14. The EHP system of claim 12, wherein said remote controller unit is actuated by the user to produce a "clear" signal transmitted to said microcomputer unit in said EHP to deactivate the plurality of first light emitting units prior to delivery of a pitch.

15. The EHP system of claim 12, further comprising an optical signal processing unit coupled to an output of said at least one photodetector for amplification and conditioning of an output signal produced by said at least one photodetector.

16. The EHP system of claim 15, further comprising an ambient light rejection circuit coupled to the output of said optical signal processing unit.

17. The EHP system of claim 12, wherein said microcomputer unit includes an FPGA (Field-Programmable Gate Array).

18. The EHP system of claim 1, wherein said EHP housing includes a shock absorbing mechanism.

19. A method for automatically determining a strike condition in a game, comprising the steps of:

(a) installing an Electronic Home Plate (EHP) at a predetermined position on a game field, wherein said EHP includes:

an EHP housing formed of a bottom module and an upper member defining a space therebetween, a plurality of first light emitting units embedded in said EHP housing in proximity to said upper member, at least one photodetector unit embedded in said EHP housing in proximity to said upper member, an indicator unit embedded in said EHP housing, and a microcomputer unit embedded in said EHP housing in operative connection with said plurality of first light emitting units, said at least one photodetector unit and said indicator unit;

(b) obtaining parameters of the strike zone at said microcomputer unit;

(c) actuating said plurality of first light emitting units to generate light beams in a predetermined spectrum range, wherein each of said light beams extends above said EHP housing and diverges vertically in direction from said upper surface of said EHP housing, (d) detecting, by said at least one photodetector unit, lights reflected from a ball crossing two of said plurality of light beams, (e) calculating, by said microcomputer unit, a crossing height at which the ball crossed said two light beams of said plurality of light beams, and (f) actuating, by said microcomputer unit, said indicator unit to produce a strike signal when said crossing height falls between a lower and a top boundaries of said strike zone.

20. The method of claim 19, further comprising the steps of:

declaring a ball condition, when in said step (d), no light is detected by said at least one photodetector unit.

21. The method of claim 19, further comprising the step of:

declaring a ball condition, when in said step (f), said crossing height fails to fall between the lower and top boundaries of said strike zone.

22. The method of claim 19, further comprising the steps of:

determining, by said microcomputer unit, time spacing between crossing of said two of said plurality of light beams by the ball, and calculating, by said microcomputer unit, a speed of the ball passing over said EHP based on said time spacing and a distance between said two light beams.

23. The method of claim 19, further comprising the steps of:

establishing a wireless communication channel between said EHP and a remote controller unit, and controlling a mode of operation of said EHP by a user through sending commands from said remote controller unit to said microcomputer unit via said wireless communication channel.

24. The method of claim 23, wherein said modes of operation include ON, OFF and CLEAR, wherein in said CLEAR mode of operation, said plurality of first light emitting units are deactivated, and wherein in said ON and OFF modes of operation, said EHP is deenergized and energized, respectively.

25. The method of claim 19, further comprising the step of:

calculating, by said microcomputer unit, a lateral position of the ball.

26. The method of claim 19, further comprising the step of:

calculating, by said microcomputer unit, an XY map of positions and speeds of pitches passing over the EHP.

* * * * *